United States Patent [19]

Oncke et al.

[11] Patent Number: 5,022,175

[45] Date of Patent: Jun. 11, 1991

[54] SAFETY ARRANGEMENT FOR FIREARMS

[76] Inventors: Ockert P. H. Oncke, 53 Stewart Street, Goodwood 7460; Sarel B. Van der Merwe, 4 Vredenberg Road, Bothasig 7405, both of South Africa

[21] Appl. No.: 471,523

[22] Filed: Jan. 29, 1990

[30] Foreign Application Priority Data

Jan. 31, 1989 [ZA] South Africa ..... 89/0743

[51] Int. Cl.[5] ..... F41A 17/04

[52] U.S. Cl. ..... 42/70.11; 42/70.08; 42/66

[58] Field of Search ..... 42/70.11, 70.01, 70.08, 42/66

[56] References Cited

U.S. PATENT DOCUMENTS

| | | | |
|---|---|---|---|
| 3,673,725 | 7/1972 | Cravener | 42/70.01 |
| 3,939,679 | 2/1976 | Barker et al. | 42/70.01 |
| 4,154,014 | 5/1979 | Smith | 42/70.01 |
| 4,189,712 | 2/1980 | Lemelson | 235/382 |
| 4,354,189 | 10/1982 | Lemelson | 340/825.31 |
| 4,457,091 | 7/1984 | Wallerstein | 42/70.11 |
| 4,488,370 | 12/1984 | Lemelson | 42/70.01 |
| 4,499,681 | 2/1985 | Bako et al. | 42/70.11 |
| 4,509,281 | 4/1985 | Dreiling et al. | 42/70.11 |
| 4,512,099 | 4/1985 | Mathew | 42/70.11 |
| 4,563,827 | 1/1986 | Heltzel | 42/70.01 |
| 4,682,435 | 7/1987 | Heltzel | 42/70.01 |
| 4,763,431 | 8/1988 | Allan et al. | 42/70.11 |

*Primary Examiner*—Michael J. Carone

*Attorney, Agent, or Firm*—Larson and Taylor

[57] ABSTRACT

A safety arrangement for selectively disabling a firearm is provided. The firearm includes a handle, a trigger, a hammer, and a barrel. The hammer, in an unlocked condition, is movable into a functional position for being actuable by the trigger for striking a magazine causing firing of a bullet and, in a locked condition, is mechanically locked so that it cannot be actuated by the trigger for causing firing of a bullet. The arrangement includes a control unit adapted in the locked condition to lock the hammer and, in the unlocked condition, to unlock the hammer; an electronic decoder unit adapted to decode input signals and to provide corresponding output signals; an electronic driver stage being adapted on receipt of the output signals from the electronic decoder unit, to cause corresponding operation of the control unit for locking and unlocking the hammer as the case may be; and a keypad unit having a number of key buttons, the key buttons being adapted on operation thereof to provide input signals to the electronic decoder unit when the keypad unit is electrically coupled thereto.

6 Claims, 4 Drawing Sheets

SAFETY ARRANGEMENT FOR FIREARMS

FIELD OF INVENTION

The present invention relates to safety arrangements. More particularly, the invention relates to safety arrangements for selectively disabling a firearm.

BACKGROUND OF INVENTION

The prior art includes a number of different firearm safety arrangements. These safety arrangements can be classified in various groups, namely:

1. The mechanical key operated type, such as disclosed in U.S. Pat. No. 4,512,099 (Mathew), U.S. Pat. No. 4,509,281 (Dreiling et al), U.S. Pat. No. 3,673,725 (Cravener).

2. The magnetically operated key type, such as found in U.S. Pat. No. 4,154,014 (Smith).

3. The electronic remote control type, having a separate controlling transmitter and a receiver located on the firearm, such as shown in U.S. Pat. No. 4,682,435 (Heltzel), U.S. Pat. No. 4,563,827 (Heltzel), U.S. Pat. No. 3,939,679 (Barker et al), U.S. Pat. No. 4,488,370 (Lemelson), U.S. Pat. No. 4,189,712 (Lemelson), U.S. Pat. No. 4,354,189 (Lemelson).

4. The mechanical combination lock type, such as described by U.S. Pat. No. 4,499,681 (Bako et al).

5. The electronically programmable key lock type, such as disclosed by U.S. Pat. No. 4,457,091 (Wallerstein).

Most of the above devices require substantial changes to be effected to a firearm prior to fitting the safety arrangement.

It is an object of the invention to provide a safety device which can be fitted to a firearm requiring a minimum of changes to such a firearm.

SUMMARY OF INVENTION

According to the invention, a safety arrangement for selectively disabling a firearm, the firearm including a handle, a trigger, a hammer, and a barrel, the hammer, in an unlocked condition, being movable into a functional position for being actuable by the trigger for striking a magazine causing firing of a bullet and, in a locked condition, being mechanically locked so that it cannot be actuated by the trigger for causing firing of a bullet, the arrangement including:

(a) a control unit mountable in the handle and being adapted in the locked condition to lock the hammer mechanically against actuation by the trigger and, in the unlocked condition, to unlock the hammer to be actuatable by the trigger for firing;

(b) an electronic decoder unit mountable in the handle and being adapted to decode input signals received from a keypad unit and, after decoding of such input signals, to provide corresponding output signals;

(c) an electronic driver stage mountable in the handle and being adapted on receipt of output signals from the electronic decoder unit, to cause corresponding operation of the control unit for locking and unlocking the hammer as the case may be;

(d) a keypad unit provided separately from the handle end having a number of key buttons, the key buttons being adapted on operation thereof to provide input signals to the electronic decoder unit when the keypad unit is electrically coupled thereto;

(e) connection means associated with the keypad unit for electrically connecting a battery thereto; and (f) first coupling means on the handle of the firearm and associated second coupling means on the keypad unit for removably electrically coupling the electronic decoder unit and the electronic driver stage to the key buttons of the keypad unit.

The control unit may include an electrical motor adapted to be driven off electrical current from the battery.

Where the firearm has a biased rod slidingly mounted in the handle and being adapted to move the hammer for causing firing of a bullet when released, the control unit may include a gear pinion adapted to be driven by the electrical motor, a gear wheel rotatably drivingly connected to the gear pinion, an aperture in the gear through which the rod can be moved, when in alignment therewith, into a functionable position being actuable by the trigger.

The disc may be concentrically fixed to the gear wheel, the disc having a disc aperture being in alignment with the aperture in the gear and through which the rod can be moved, when in alignment therewith, into a functionable position for being actuable by the trigger.

Also according to the invention, there is provided the combination of a firearm including a handle, a trigger, a hammer, and a barrel, the hammer, in an unlocked condition, being movable into a functional position for being actuable by the trigger for striking a magazine causing firing of a bullet and, in a locked condition, being mechanically locked so that it cannot be actuated by the trigger for causing firing of a bullet; and a safety arrangement for selectively disabling the firearm, the arrangement including:

(a) a control unit mounted in the handle and being adapted in the locked condition to lock the hammer mechanically against actuation by the trigger and, in the unlocked condition, to unlock the hammer to be actuatable by the trigger for firing;

(b) an electronic decoder unit mounted in the handle and being adapted to decode input signals received from a keypad unit and, after decoding of such input signals, to provide corresponding output signals;

(c) an electronic driver stage mounted in the handle and being adapted on receipt of output signals from the electronic decoder unit, to cause corresponding operation of the control unit for locking and unlocking the hammer as the case may be;

(d) a keypad unit having a number of key buttons, the key buttons being adapted on operation thereof to provide input signals to the electronic decoder unit when the keypad unit is electrically coupled thereto; and (e) connection means associated with the keypad unit for electrically connecting a battery thereto.

BRIEF DESCRIPTION OF DRAWINGS

The invention will now be described by way of example with reference to the accompanying schematic drawings.

In the drawings there is shown in

DETAILED DESCRIPTION OF DRAWINGS

Figure 1:
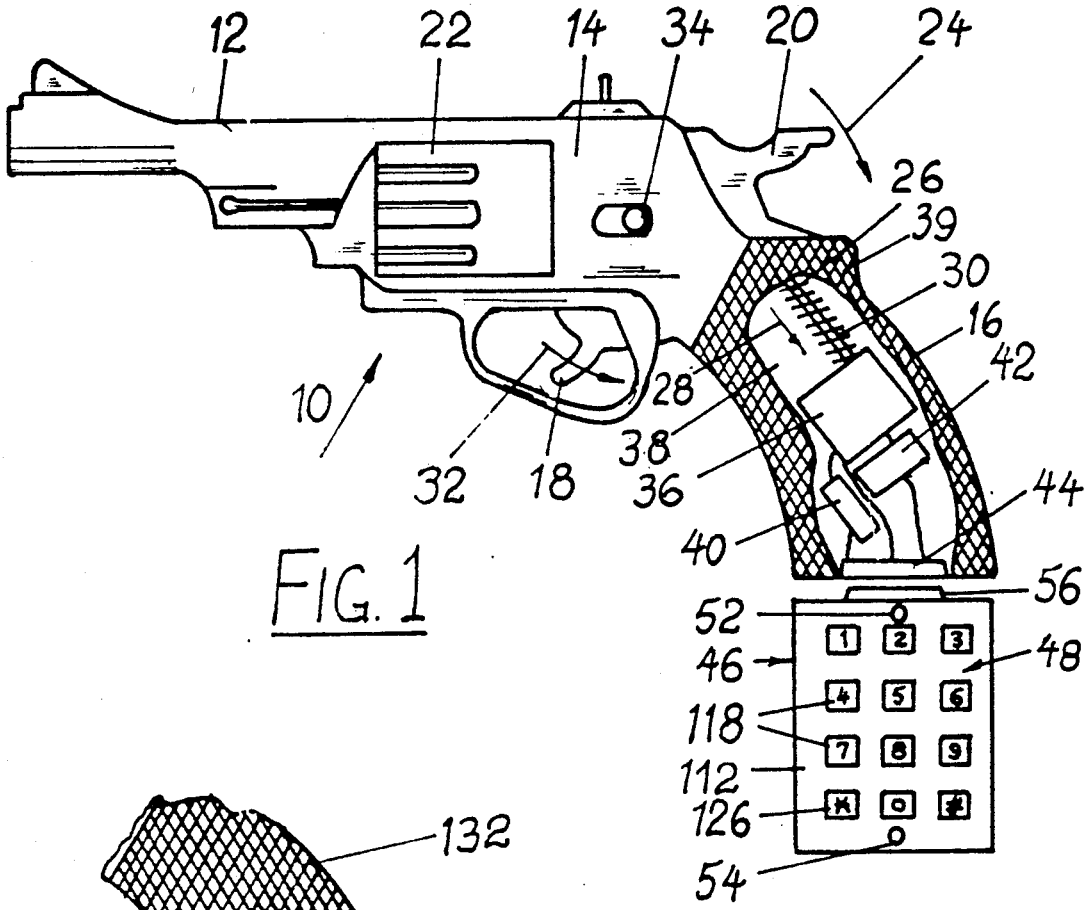
FIG. 1 a side view of a keypad unit and a firearm in the form of a revolver provided with a safety arrangement in accordance with the invention, the revolver being partly cut open in the handle area to reveal operational parts of the safety arrangement.

Referring to FIG. 1 a firearm, which is in the form of a conventional revolver 10, is illustrated. This conventional revolver 10 includes a barrel 12, a body 14, a grip, handle or stock 16 (hereinafter referred to as the handle 16), a trigger 18, and a cock or target hammer 20.

The trigger 18 and the hammer 20 are pivotably mounted and cooperate in conventional manner and are not described in further detail.

As is normal practice, when a bullet is to be fired from a cartridge placed in the magazine cylinder 22 through the barrel 12, the hammer 20 is first pivoted in the direction indicated by arrow 24 so as to be cocked. In doing so the hammer 20 slidingly moves the main spring rod 26 in the direction indicated by arrow 28 against the action of the main spring 30. The hammer 20 is then locked and held in a position ready for firing under tension of the spring 30 as the spring acts between a support on the handle and a collar 31 provided on the rod 26. When the trigger 18 is pulled in the direction indicated by arrow 32, the rod 26 is released (by means not shown) and the spring 30 rapidly forces the rod 26 in a direction opposite to that indicated by arrow 28. Therewith the hammer 20 is pivoted in a direction opposite to that indicated by arrow 24 and hits onto the cartridge causing ignition and the firing of the bullet.

In some revolvers a safety locking mechanism 34 is provided by means of which the hammer 20 is locked so that it cannot be pulled back for cocking it prior to firing.

As is explained hereafter, the safety arrangement in accordance with the invention is adapted to control the movement of the rod 26 and therewith the firing of the revolver.

It must be understood that the fitting of a safety arrangement as suggested by the invention requires only minor changes in an existing revolver. In fact, except for ensuring that a sufficiently large recess is available for locating the various components of the safety arrangement and for removing the conventional abutting stop of the spring 30 against the handle 16, no other changes are required.

The safety arrangement in accordance with the invention basically includes the following components:

1. A control unit 36, which is located in a recess 38 provided in the handle 16 and is covered to the outside by a cover 39.

2. An electronic decoder unit 40 also located in the recess 38.

3. An electronic driver stage 42 also located in the recess 38.

4. A plug 44 located at the bottom of the handle 16.

5. A separate keypad unit 46 with a keypad 48, a battery 50 (see FIG. 4), a green inoperative or locked light emission diode 52 a red operative or unlocked light emission diode 54 and a socket 56, which is associated with the plug 44 on the handle 16.

Figure 2:
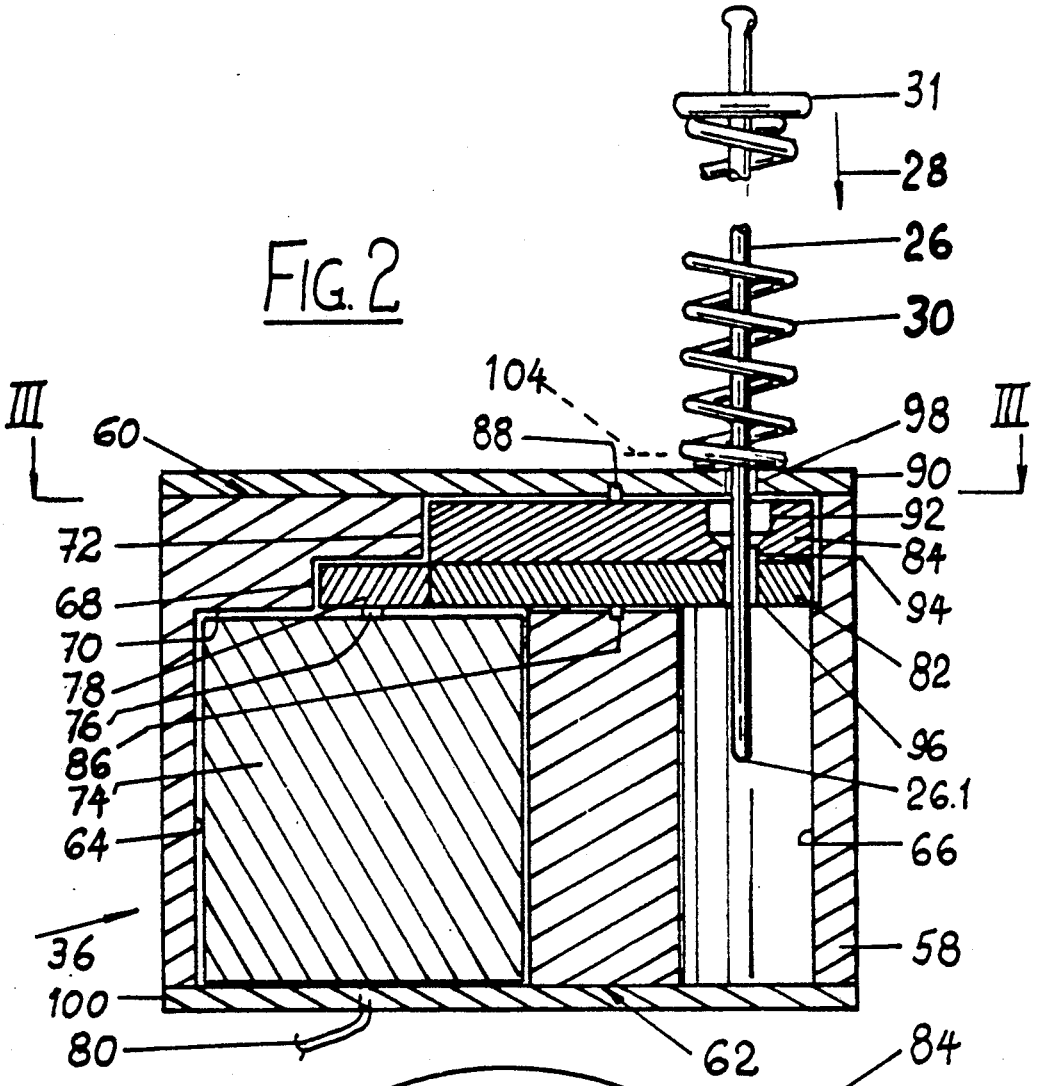
FIG. 2 on a larger scale, a sectional side view of the operating unit seen along arrows II—II in FIG. 3.
Figure 3:
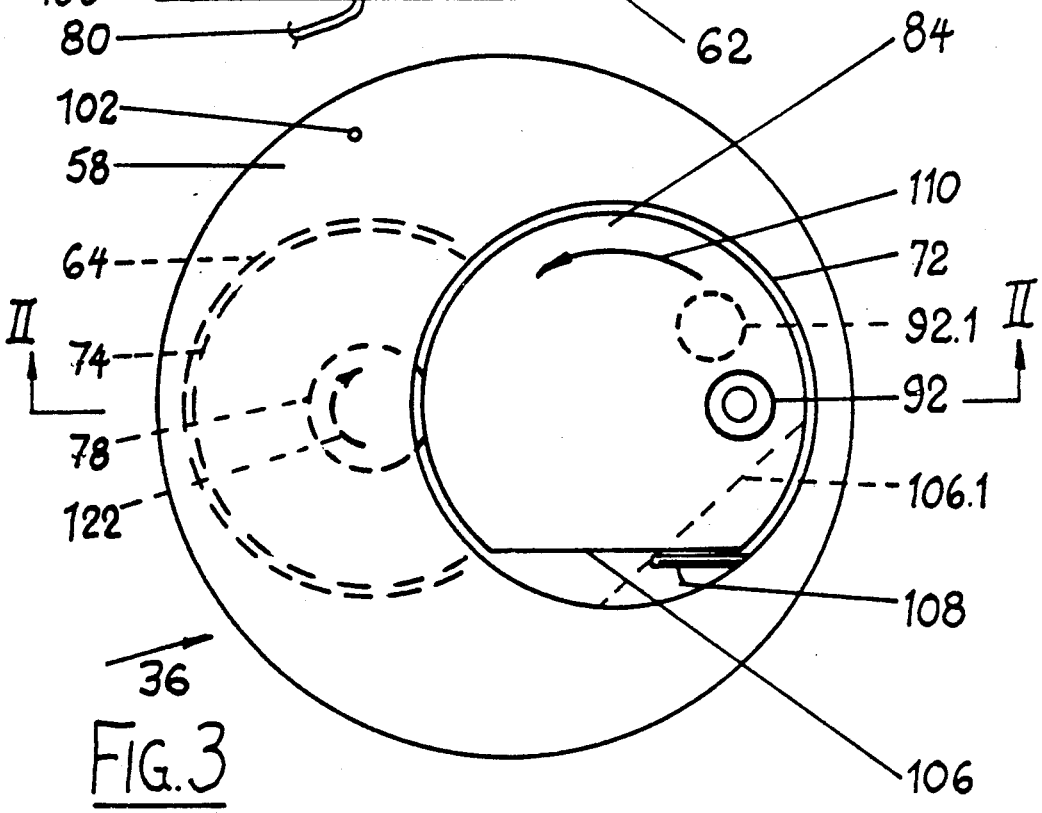
FIG. 3 a top view on the operating unit seen along arrows III—III in FIG. 2 but with the top end sealing plate removed and the main spring rod not being shown.

Referring now to FIGS. 2 and 3, the control unit, generally indicated by reference numeral 36, includes a block 58 made of solid material, such as aluminium. The block 58 is of round cylindrical shape (but it can also be of square shape if convenient) and has two end faces, namely an upper end face 60 and a bottom end face 62.

From the face 62 holes 64 and 66 are drilled into the block 58. Thereafter a further hole 68 is drilled from the inner end face 70 of the hole 64. From the end face 60 a hole 72 is drilled into the block 58.

An electrical motor 74 is fitted into the hole 64. It has a shaft 76 on which a driving pinion 78 is fitted. An electrical conductor 80 leads to the motor 74.

The pinion 78 meshes with a gear wheel 82 which is fitted from the face 60 into the hole 72. A disc 84 is fixed concentrically to the gear wheel 82. The gear wheel 82 and the disc 84 are together supported rotatably by means of two stub shafts 86, 88, which are rotatably mounted by respectively rotatingly fitting into the block 58 and the upper sealing plate 90.

The disc 84 has a widened hole 92 leading into a smaller hole 94, which is in alignment with a hole 96 in the gear wheel 82.

The upper end of the block 58 is closed off, after fitting of the gear wheel 82 and its associated disc 84, by sealing the end plate 90 thereto. As mentioned before, the end plate 90 rotatably locates the stub shaft 88. It further has a hole 98 through which the rod 26 can extend. As is shown in the operational condition (as will be explained hereafter) the rod 26 extends through this hole 98, the widened hole 92, the hole 94 and the hole 96 into the hole or space 66.

The bottom end of the block 58 is closed off by means of the sealing plate 100, which has a hole 102 for the conductor 80 to pass therethrough.

FIG. 2 shows the rod 26 in the active or operative position when the hammer 20 has been cocked for firing. In this condition the rod 26 extends into the hole 66. When the trigger 18 is pulled, the spring 30, which abuts against the upper plate 90, pushes the rod 26 rapidly in a direction opposite to that indicated by arrow 28 to cause the hammer 20 to strike the cartridge for firing the bullet.

On the other hand, in the uncocked position of the hammer 20, the bottom end 26.1 of the rod 26 is located above the plate 90, at a position indicated by dotted lines 104. When in this position, and if, for locking, the disc 84 and the gear wheel 82 have been rotated, as will be explained hereinafter, so that the holes 92, 94, and 96 are not in alignment with the rod 26, the rod 26 will, if the hammer 20 is moved in the direction indicated by arrow 28, merely pass through the hole 98 in the plate 60 and then abut against and be stopped by the upper face of the disc 84. Therefore the hammer 20 cannot be pulled back for locking it prior to firing.

Referring to FIG. 3, the disc 84 is shown to have a cut-out with a cut-out edge 106. An associated stop pin 108 is mounted in the hole 72 adjacent the cut-out edge 106. In the position illustrated in FIG. 3 the pin 108 prevents further rotation of the disc 84 in an anti-clockwise direction and the disc 84 now is in operative condition. In this position the rod 26 can pass through the hole 92, etc. When the disc 84 is rotated into the locking or inoperative condition in the direction indicated by arrow 110, the hole 92 is displaced to the position indicated by dotted lines 92.1. The cut-out edge 106 accordingly moves into the position indicated by dotted lines 106.1 and then abuts against the tip of the pin 108 preventing further rotation of the disc 84. The pin 108 therefore limits the rotation of the disc 84, and therewith the gear wheel 82 through a particular angle.

Figure 4:
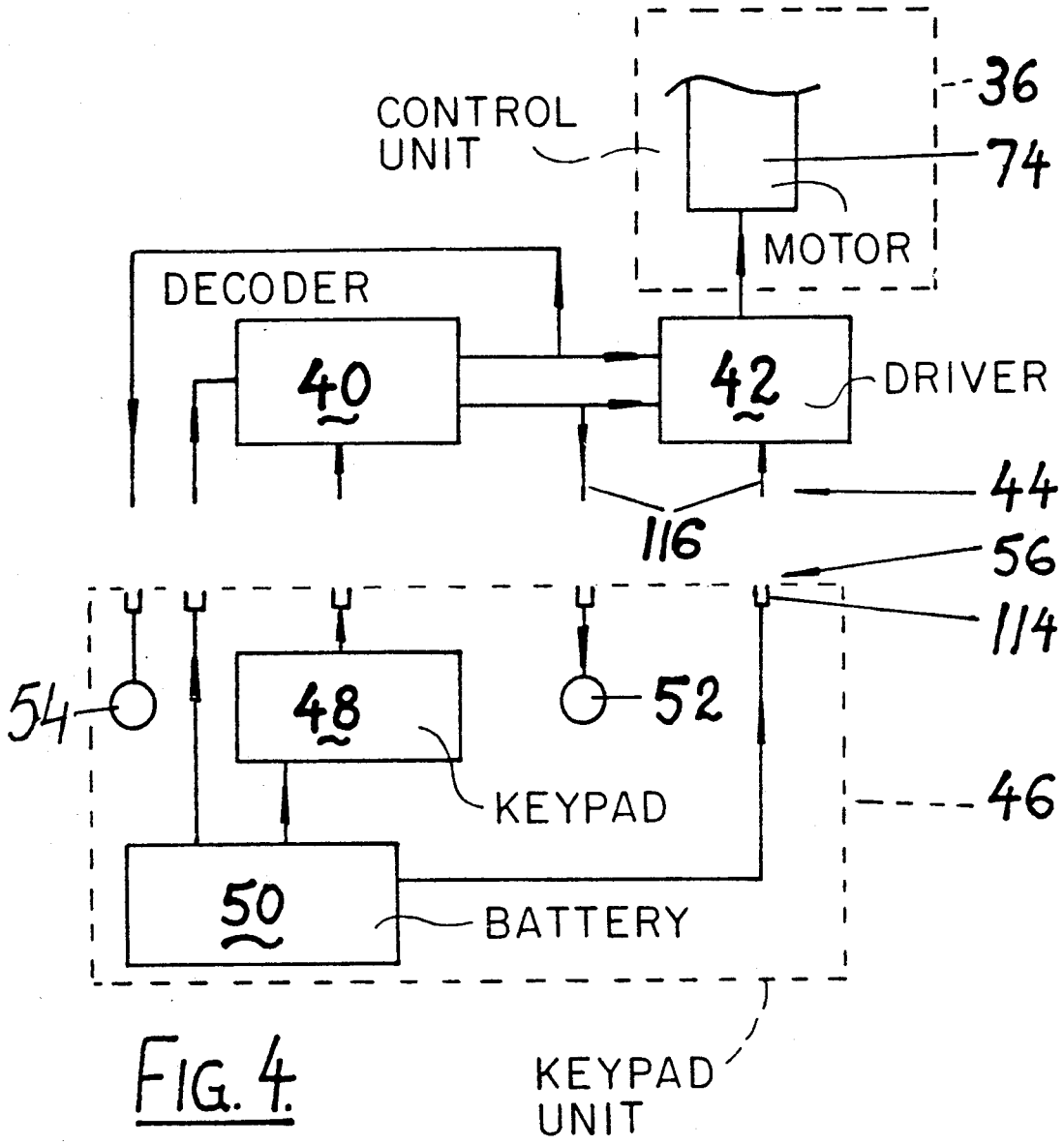
FIG. 4 a simplified block diagram of the circuitry of the safety arrangement in accordance with the invention.

In FIG. 4 a simplified block diagram of the safety system in accordance with the invention is illustrated. It includes the separate keypad unit 46 having a housing 112 (see FIG. 1) in which the battery 50 is contained. It further has the light emitting diodes 52 and 54 and the socket 56 with the individual sockets 114.

The control unit 36, which is housed in the handle 16 of the revolver 10, includes the electrical motor 74 and associated parts as illustrated in FIGS. 2 and 3. Furthermore the electronic decoder unit 40 and the driver stage 42 are mounted in the handle 16. The plug 44 with the plug pins 116, associated with the sockets 114 of the keypad unit 46, are provided at the bottom of the handle 16.

The keypad 48 includes the various key buttons 118 as shown in FIG. 1.

Figure 5:
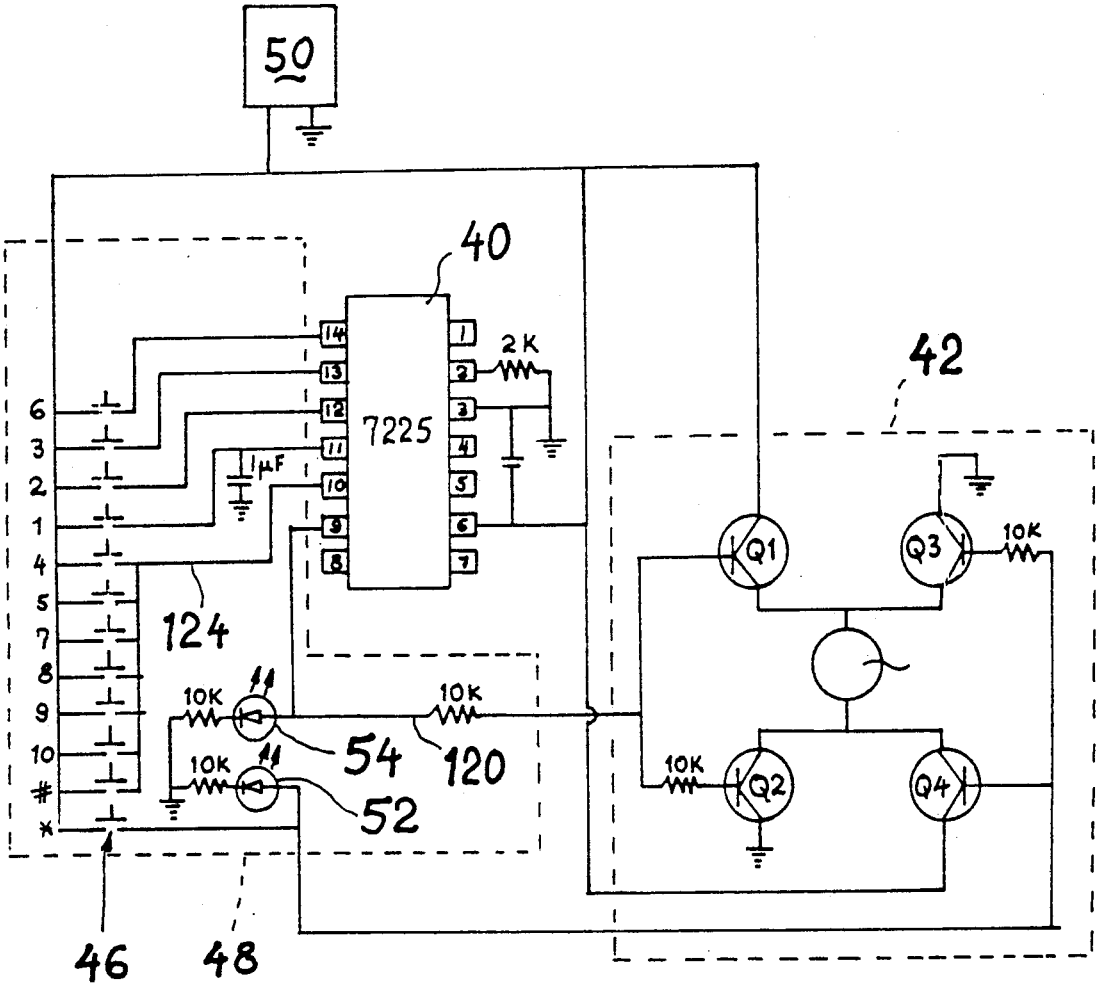
FIG. 5 a circuit diagram of the circuitry of the safety arrangement in accordance with the invention.

In FIG. 5 a detailed circuit diagram is shown.

The keypad 48 is of a miniature type and has conductive rubber contacts, which require a low operating force.

The electronic decoder unit 40 includes a low power integrated circuit (commercially available under number RS 7225) with inputs to accommodate a four bit code sequence. It has the ability to detect an out of sequence entry or incorrect entry.

The transistor network, constituting the electronic driver stage 42, consists of four NPN transistors Q1, Q2, Q3, Q4 (commercially known under the reference 2N2926). They are designed such that should a correct signal be sent from the electronic decoder unit 40 (RS7225) via the conductor 120 it will drive the motor 74 in anti-clockwise direction (opposite to that indicated by arrow 122 in FIG. 3). Alternatively, if a reset signal is applied from the keypad 48, the motor 74 is turned in a clockwise direction as indicated by arrow 122 in FIG. 3.

The motor 74 is of a miniature permanent magnet DC type.

The light indicators include two LED indicators (light emitting diodes), namely a green indicator 52 and a red indicator 54. The green indicator light 52 indicates that the revolver is "safe" (locked or immobilized) and the red indicator light 54 that the revolver is "ready to fire" (unlocked).

The various components briefly perform the following operations:

1. The keypad 48 is used for entering the code to unlock the revolver or to reset for locking the revolver.
2. The electronic decoder unit 40 interprets the code received.
3. The electronic drive stage 42 drives the output signal of the electronic decoder unit 40.
4. The electric motor 74 is adapted, via the pinion 78, to turn the disc 84 and the gear wheel 82 either to allow or to inhibit the rod 26 to slide into the space or hole 66.

A more detailed operation of the circuit diagram is as follows:

To put the revolver 10 into the operative position, the keypad unit 46 is coupled to the handle 16 by joining the plug 44 on the handle 16 and socket 56 on the keypad unit 46. Then the correct four digit code is entered in sequence by way of the buttons 118 on the keypad 48. The resulting "pulses" are sent to the pins 11, 12, 13, and 14 respectively. The IC 7225 checks the correct sequence via its incorporated sequential detector and sequential memory. If the sequence is correct, a logic 1 will appear on the output (being pin 9) of the IC 7225. The duration of a pulse is a function of the external capacitance connected to the pin 11 and the supply voltage, which determines the time allowed to enter the input code.

Should any of the unselected buttons be depressed on the keypad 48, a signal will be sent along the conductor 124 and the IC 7225 will detect this via pin 10. The input sequential detector inside the IC 7225 will be reset. To unlock the revolver 10 the correct input sequence would have to be keyed in.

When the correct code has been keyed in, the output pulse (from pin 9) is sent to the red LED light 54, which will illuminate to indicate that the correct sequence has been entered and the base of the transistors Q1 and Q2 will be forward biased, that is "switched on". Current will flow from the battery 50 through the collector—emitter of the transistor Q1, through the winding of the motor 74 and through the collector--emitter of the transistor Q2. This will in turn cause the motor 74 to turn the pinion 78 in an anti-clockwise direction (opposite to arrow 122 shown in FIG. 3) and thus the gear wheel 82 and associated disc 84 will be turned in a clockwise direction (opposite to that indicated by arrow 110 in FIG. 3) until the cut-out edge 106 abuts against the pin 108 as shown in FIG. 3. The hole 92 and associated holes 94, 96 then will be in alignment with the rod 26 so that it can be retracted into the hole 66 to allow the hammer 20 to be "cocked" and hence to be in a "ready to fire" condition.

To return the revolver 10 to the "safe" condition the hammer 20 must be uncocked, that is the end 26.1 of the rod 26 must be out of the unit 36 and in the position 104 shown in FIG. 2. Then the reset button 126 on the keypad 48 is depressed and a "high" (reset) signal flows from the keypad 48 along conductor 128 to forward bias the base of transistors Q3 and Q4. Current then flows through the collector—emitter of Q4, through the winding of the motor 74 and through the collector—emitter of transistor Q3. This will cause the motor 74 to turn in the opposite direction, that is in the direction indicated by arrow 122 in FIG. 3. The gear wheel 82 and the disc 84 then are rotated in anti-clockwise direction as indicated by arrow 110 in FIG. 3 until the tip of the pin 108 abuts against the cutout edge 106 in its new position indicated by dotted lines 106.1. Now the hole 92 is in the position indicated by dotted lines 92.1 and the rod 26 cannot be moved through the various holes into the hole 66 because these are not in alignment with the rod 26. Thereby the hammer 20 is unable to be pulled back into "cocked" position for firing. At the same time the green light 52 will be illuminated indicating that the revolver 10 is now in a "safe" condition.

For operating the arrangement the following procedure is followed:

1. The keypad unit 46 is fitted to the handle 16 of the revolver 10 by coupling the socket 56 of the keypad 46 to the plug 44 at the bottom of the handle 16. Checking takes place by simply pressing the reset button 126 on the keypad 48 to see that the green light 52 is illuminated.

2. The secret four digit code is correctly entered within the set time period (for example, three seconds after the first digit is pressed), then the red light 54 will be illuminated momentarily and this will indicate that the revolver 10 is now ready to fire.

3. The keypad unit 46 may then be removed from the handle 16 of the revolver 10 leaving the revolver 10 in the "unsafe" or operative condition. It can be left in this condition for any length of time.

4. To make the revolver "safe" (immobilized or locked) again, the keypad unit 46 is merely connected to the plug 44 and the reset button 126 is pressed. The green light 52 will be illuminated indicating that the revolver is "safe" once again.

From the above it is clear that if the revolver 10 is in the cocked condition, an unauthorized person (e.g. a child or a thief) cannot unlock the revolver without the keypad unit 46. Even if such an unauthorized person has the keypad unit 46 available he would still have to know and enter the correct code for unlocking the revolver.

Furthermore, if a person wishes to remove the control unit 36, he would have to break open the handle 16. He then would have to remove the unit 36 and provide an abutting base or stop for the spring 30 to abut against. This generally is time consuming and will require the skills of an experienced toolmaker or gunsmith.

As ten digits are available for coding in a particular sequence of 4 key numbers, a vast number of different codes are available so that the chances of an unauthorized person determining the correct code are negligent.

If an owner of a firearm wishes to change the code of the revolver, the wire connections between the keypad 46 and the IC 7225 can be changed for selecting another code. However, this also will be time consuming and requires a skilled person to effect such alterations.

Figure 6:
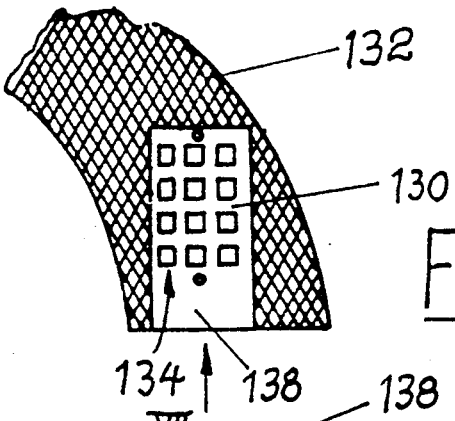
FIG. 6 a side view of a handle of a firearm in the form of a revolver provided with a safety arrangement in accordance with the invention as illustrated in FIGS. 1 to 5 but with the keypad unit fitted onto the handle.
Figure 7:
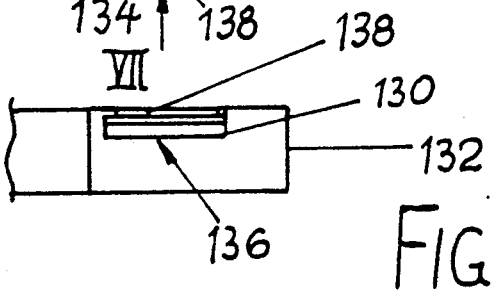
FIG. 7 an end view of the handle seen along arrow VII in FIG. 6.

In FIG. 6 and 7 an alternative arrangement is shown in which the keypad 130 is not a separate unit but is fitted onto the handle 132 of the gun. In this arrangement the key buttons 134 are permanently connected to the electronic decoder unit and therefore the plug 44 and the socket 56 of FIGS. 1 to 5 become redundant. The keypad 130 is provided in a recess 136 in the handle 132 and is covered by means of a slidable cover plate 138. The components and operation of this arrangement is similar to that as illustrated and described with reference to FIGS. 1 to 5.

I claim:

1. A safety arrangement for selectively disabling a firearm, the firearm including a handle, a trigger, a hammer, and a barrel, the hammer, in an unlocked condition, being movable into a functional position for being actuable by the trigger for striking a cartridge causing firing of a bullet and, in a locked condition, being mechanically locked so that is cannot be actuated by the trigger for causing firing of a bullet, the arrangement including:

(a) a control unit mountable in the handle and being adapted in the locked condition to lock the hammer mechanically against actuation by the trigger and, in the unlocked condition, to unlock the hammer to be actuable by the trigger for firing;

(b) an electronic decoder unit mountable in the handle and being adapted to decode input signals received from a keypad unit and, after decoding of such input signals, to provide corresponding output signals;

(c) an electronic driver stage mountable in the handle and being adapted on receipt of output signals from the electronic decoder unit, to cause corresponding operation of the control unit for locking and unlocking the hammer as the case may be;

(d) a keypad unit provided separately from the handle and having a number of key buttons, the key buttons being adapted on operation thereof to provide input signals to the electronic decoder unit when the keypad unit is electrically coupled thereto;

(e) connection means associated with the keypad unit for electrically connecting a battery thereto; and (f) first coupling means on the handle of the firearm and associated second coupling means on the keypad unit for removably electrically coupling the electronic decoder unit and the electronic driver stage to the key buttons of the keypad unit.

2. An arrangement as claimed in claim 1, in which the control unit includes an electrical motor adapted to be driven off electrical current from the battery.

3. An arrangement as claimed in claim 1, and where the firearm has a biased rod slidingly mounted in the handle and being adapted to move the hammer for causing firing of a bullet when released, and the control unit includes a gear pinion adapted to be driven by the electrical motor, a gear wheel rotatably drivingly connected to the gear pinion, an aperture in the gear through which the rod can be moved, when in alignment therewith, into a functionable position for being actuable by the trigger.

4. An arrangement as claimed in claim 3 in which a disc is concentrically fixed to the gear wheel, the disc having a disc aperture being in alignment with the aperture in the gear and through which the rod can be moved, when in alignment therewith, into a functionable position for being actuable by the trigger.

5. An arrangement as claimed in claim 3 in which limiting means is provided for limiting the rotational angle through which the gear wheel can be rotated.

6. The combination of a firearm including a handle, a trigger, a hammer, and a barrel, the hammer, in an unlocked condition, being movable into a functional position for being actuable by the trigger for striking a cartridge causing firing of a bullet and, in a locked condition, being mechanically locked so that it cannot be actuated by the trigger for causing firing of a bullet; and a safety arrangement for selectively disabling the firearm, the arrangement including:

(a) a control unit mounted in the handle and being adapted in the locked condition to lock the hammer mechanically against actuation by the trigger and, in the unlocked condition, to unlock the hammer to be actuable by the trigger for firing;

(b) an electronic decoder unit mounted in the handle and being adapted to decode input signals received from a keypad unit and, after decoding of such input signals, to provide corresponding output signals;

(c) an electronic driver stage mounted in the handle and being adapted on receipt of output signals from the electronic decoder unit, to cause corresponding operation of the control unit for locking and unlocking the hammer as the case may be;

(d) a keypad unit provided separately from the handle and having a number of key buttons, the key buttons being adapted on operation thereof to provide unput signals to the electronic decoder unit when the keypad unit is electrically coupled thereto;

(e) connection means associated with the keypad unit for electrically connecting a battery thereto; and (f) first coupling means on the handle of the firearm and associated second coupling means on the keypad unit for removably electrically coupling the electronic decoder unit and the electronic driver stage to the key buttons of the keypad unit.

* * * * *